US006029902A

United States Patent [19]

Hickey et al.

[11] Patent Number: 6,029,902

[45] Date of Patent: Feb. 29, 2000

[54] FUEL INJECTOR WITH ISOLATED SPRING CHAMBER

[75] Inventors: Daniel K. Hickey, Greenwood; Daniel K. Vetters, Columbus; Bruce E. Varney, Columbus; Tibor Kiss, Columbus, all of Ind.

[73] Assignee: Cummins Engine Company, Inc., Columbus, Ind.

[21] Appl. No.: 09/048,114

[22] Filed: Mar. 26, 1998

[51] Int. Cl.[7] ..... F02M 47/02

[52] U.S. Cl. ..... 239/88; 239/127; 239/533.8

[58] Field of Search ..... 239/88–91, 95, 239/533.4–533.5, 127, 533.8

[56] References Cited

U.S. PATENT DOCUMENTS

| | | | |
|---|---|---|---|
| 4,531,672 | 7/1985 | Smith . | |
| 4,721,247 | 1/1988 | Perr . | |
| 5,033,442 | 7/1991 | Perr et al. . | |
| 5,042,445 | 8/1991 | Peters et al. | 239/88 X |
| 5,076,236 | 12/1991 | Yu et al. | 239/88 X |
| 5,275,337 | 1/1994 | Kolarik et al. . | |
| 5,299,738 | 4/1994 | Genter et al. . | |
| 5,320,278 | 6/1994 | Kolarik et al. . | |
| 5,441,027 | 8/1995 | Buchanon et al. . | |
| 5,611,317 | 3/1997 | Peters et al. | 239/95 X |

FOREIGN PATENT DOCUMENTS 2140099 11/1984 United Kingdom .

*Primary Examiner*—Kevin Weldon
*Assistant Examiner*—Sean P. O'Hanlon
*Attorney, Agent, or Firm*—Sixbey, Friedman Leedom & Ferguson; Charles M. Leedom, Jr; Tim L. Brackett Jr.

[57] ABSTRACT

An improved unit fuel injector is provided which effectively and precisely controls the timing of fuel injection by avoiding outside influences acting on a timing plunger. The unit fuel injector includes a timing plunger positioned between upper and lower plungers, a timing chamber positioned between the timing plunger and upper plunger and a spring chamber positioned between the timing plunger and a metering chamber for containing one or more springs for biasing the plungers. A spring chamber drain valve device is provided for directing fuel in the spring chamber to a low pressure drain while isolating the spring chamber from the low pressure drain system thereby preventing pressure variations in the drain system from entering the spring chamber and acting on the timing plunger. In addition, a scavenge circuit is provided to direct a scavenging flow of fuel and combustion gas from the injector directly to the low pressure drain without communication with the spring chamber. Consequently, pressure variations in the spring chamber are minimized thereby reducing the variations in biasing force on the timing plunger 38 to permit precise control of the timing fluid metering into the timing chamber by simply varying the timing fluid pressure.

17 Claims, 1 Drawing Sheet

FUEL INJECTOR WITH ISOLATED SPRING CHAMBER

TECHNICAL FIELD

The present invention relates to a high pressure fuel injector, including a metering and timing plunger assembly forming a timing chamber, which is capable of accurately and effectively controlling the timing of the start of fuel injection by precisely controlling the amount of timing fluid introduced into the timing chamber.

BACKGROUND OF THE INVENTION

Unit fuel injectors operated by cams, have long been used in compression ignition internal combustion engines for their accuracy and reliability. The unit injector, whether of the open or closed nozzle type, typically includes an injector body having injector orifices at one end and a cam driven injector plunger assembly mounted for reciprocal movement within the injector body. In a typical unit injector, fuel is metered into an injection chamber with the amount of fuel being controlled on a cycle by cycle basis.

As the need for higher engine efficiency and emissions abatement have increased, it has become increasingly evident that the timing of the injection event, with respect to the movement of the corresponding engine piston, must be precisely and reliably controlled during each cycle, independently from injection metering, in response to changing engine operating conditions. U.S. Pat. No. 4,721,247 discloses an open nozzle fuel injector capable of controlling the timing of injection. The injector includes an upper plunger, a lower or metering plunger and an intermediate or timing plunger. The lower plunger is biased against the timing plunger by a return spring positioned in a chamber formed between the timing plunger and the metering chamber. The spring chamber is continuously connected to drain via drain ports formed in the injector body. A variable volume hydraulic timing chamber is formed between the upper plunger and the timing plunger. Timing fluid is delivered to the timing chamber based on the "pressure/time" principle whereby the amount of timing fluid actually metered into the timing chamber is a function of primarily the supply pressure and, secondarily, the total metering time that timing fluid flows through a port in the injector. Therefore, the timing of fuel injection is controlled by varying the timing fluid pressure.

U.S. Pat. No. 5,299,738 to Genter et al. discloses an open nozzle fuel injector assembly similar to the injector disclosed in the '247 patent except that the retraction stroke of the lower plunger is limited to reduce the quantity of gas being drawn into the injector from the combustion chamber during the retraction stroke. A stop surface is formed on the injector body for abutment by a spring-biased keeper mounted on the upper end of the lower plunger and biased by a coil spring, thereby forming a cushioned stop. During the retraction stroke, the retraction movement of the lower plunger is stopped while the timing and upper plungers continue through the retraction stroke. U.S. Pat. No. 5,275,337 discloses a similar unit injector including a second spring positioned between the lower plunger and the timing plunger to assist in the retraction of the timing plunger thereby advantageously improving start of injection variability.

The injectors discussed hereinabove are incapable of achieving the degree of precise control over the timing of injection required for optimum efficiency and emissions abatement. Each of these conventional injectors undesirably permit the start of injection to vary to an unacceptable degree from one cycle to the next.

Consequently, there is a need for a unit injector having a variable volume timing chamber which is capable of precisely controlling the amount of timing fluid delivered to the timing chamber during each timing event thereby reducing start of injection variation and improving efficiency and emissions abatement.

SUMMARY OF THE INVENTION

It is an object of the present invention, therefore, to overcome the disadvantages of the prior art and to provide a unit injector capable of effectively and precisely varying the timing of injection to achieve improved efficiency and emissions abatement.

Another object of the present invention is to provide a unit injector having a variable volume timing chamber which permits the length of the fluid link created in the timing chamber to be precisely controlled by varying the pressure of the timing fluid.

Yet another object of the present invention is to provide a unit injector having a variable volume timing chamber which avoids undesired pressure forces acting on the timing plunger.

A further object of the present invention is to provide a unit injector, having a variable volume timing chamber, which minimizes unwanted variations in the timing of the start of injection.

A still further object of the present invention is to provide a unit injector, having a variable volume timing chamber, which reduces the amount of fuel which must be displaced during maximum advance conditions.

Still another object of the present invention is to provide a unit injector which permits maximum advancement of injection timing while preventing drain pressure from adversely affecting timing fluid metering.

A further object of the present invention is to provide a unit injector, having a variable volume timing chamber, which avoids the use of a positive stop for limiting the retraction of the timing plunger.

Still another object of the present invention is to provide a unit injector, having a variable volume timing chamber, which minimizes the amount of fuel in a spring chamber formed on an opposite side of the timing plunger from the timing chamber.

Yet another object of the present invention is to provide a unit injector, having a variable volume timing chamber, which minimizes the size of a drain passage connected to a spring chamber adjacent the timing plunger by limiting the flow fluid into the spring chamber to leakage fuel only.

These and other objects of the present invention are achieved by providing a unit fuel injector for injecting fuel into a combustion chamber of an internal combustion engine comprising an injector body containing a central bore and an injection orifice formed in one end to discharge fuel into the combustion chamber. The unit fuel injector includes a lower plunger positioned for reciprocal movement in the central bore and a metering chamber positioned between the lower plunger and the injection orifice for receiving a metered quantity of fuel for injection on a periodic basis. The unit fuel injector further includes a fluid timing arrangement for varying the timing of each periodic injection of metered fuel dependent upon the pressure of a timing fluid supplied to the injector body wherein the fluid timing arrangement includes an upper plunger mounted for reciprocal movement within the central bore, an intermediate plunger mounted for reciprocal movement within the central bore between the upper and the lower plungers and a variable volume timing chamber formed in the central bore between the intermediate plunger and the upper plunger for receiving timing fluid to form a fluid link having a variable effective length. The unit injector further includes a spring chamber formed axially between the intermediate plunger and the metering chamber, and a spring positioned in the spring chamber for biasing at least one of the intermediate plunger and the lower plunger toward the upper plunger. Importantly, the unit fuel injector of the present invention includes a spring chamber drain valve for directing fuel and timing fluid from the spring chamber to a low pressure drain and for preventing flow from the low pressure drain into the spring chamber.

The spring chamber drain valve may be of the ball check valve type. The injector body includes a spring housing containing a valve seat for engagement by the ball check valve which is positioned in a drain passage formed in the spring housing. The ball check valve preferably moves axially along a longitudinal axis of the injector body between an open position and a closed position. The unit fuel injector is preferably of the open nozzle type and the spring preferably includes a first coil spring biasing the lower plunger toward the upper plunger and a second coil spring biasing the intermediate plunger toward the upper plunger. Preferably, the ball check valve is moved between an open position and a closed position solely by differential fluid pressure across the ball check valve. The unit injector may also include a scavenge flow circuit formed in the injector body for directing a scavenge flow of fuel through the injector body to remove combustion gases from the central bore i.e. metering chamber. The scavenge flow circuit is formed in the spring housing fluidically separate from the spring chamber for bypassing fuel and gas around the spring chamber for delivery directly to the lower pressure drain. Preferably, the intermediate plunger is mounted for unrestricted movement toward the upper plunger thereby maximizing an injection timing range.

DETAILED DESCRIPTION OF THE PREFERRED EMBODIMENT

Figure 1:
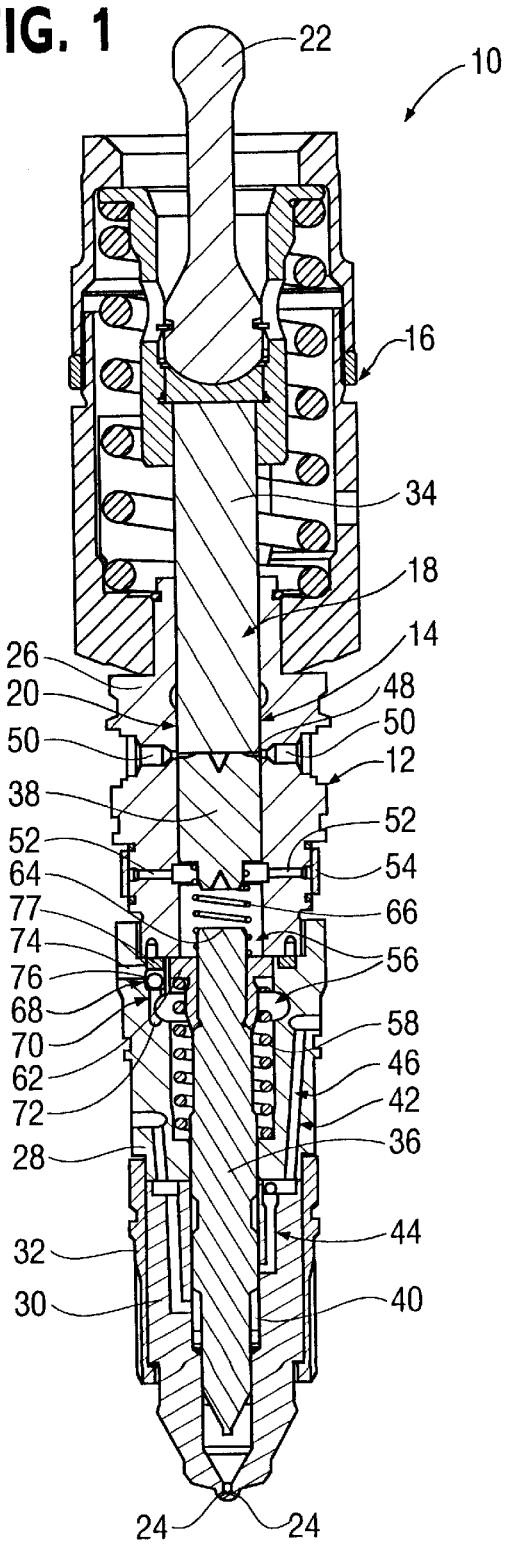
FIG. 1 is a cross sectional view of the unit injector of the present invention.

Referring to FIG. 1, there is shown the unit fuel injector of the present invention, indicated generally at 10, which accurately and effectively controls the timing of the start of fuel injection to optimize efficiency and emissions abatement. Unit fuel injector 10 generally includes an injector body 12 having a central bore 14, a top stop housing 16 mounted on the injector body 12 and a plunger assembly 18 mounted in central bore 14. A fluid timing arrangement 20, which includes portions of plunger assembly 18, permits variable control of the timing of fuel injection. As discussed hereinbelow, unit fuel injector 10 includes one or more features which allow fluid timing arrangement 20 to optimally control the timing of fuel injection without being adversely affected by undesirable factors.

Unit fuel injector 10 is preferably of the open nozzle type wherein plunger assembly 18 is driven by an injector drive train (not shown) via a link 22 to force fuel through injection orifices 24 which remain open throughout operation. Injector body 12 includes a barrel 26, a spring housing 28 connected to barrel 26 by, for example, a threaded connection, a nozzle housing 30 and a nozzle retainer 32 securing nozzle housing 30 to the lower end of spring housing 28. Spring housing 28 is positioned intermediate outer barrel 26 and nozzle housing 30 while central bore 14 extends through each of the housings. Spring housing 28 may be connected to barrel 26 by a threaded connection or, preferably, by a pinned connection such as disclosed in co-pending application Ser. No. 09/049,110 entitled "Pinned Injector Assembly", filed Mar. 27, 1998 commonly assigned to the assignee of the present application, and the entire contents of which is hereby incorporated by reference. Plunger assembly 18 includes an upper plunger 34 extending outwardly from central bore 14 into top stop housing 16, and a lower plunger 36 reciprocally mounted in central bore 14 of spring housing 28 and nozzle housing 30. Top stop housing 16 may be any conventional top stop housing for limiting the upward movement of upper lunger 34, but is preferably the top stop assembly disclosed in co-pending application Ser. No. 09/049,379 entitled "Top Stop Assembly for a Fuel Injector", filed Mar. 27, 1998, now U.S. Pat. No. 5,934,254 commonly assigned to the assignee of the present application, and the entire contents of which is hereby incorporated by reference. Plunger assembly 18 further includes an intermediate or timing plunger 38 reciprocally mounted in central bore 14 axially between upper plunger 34 and lower plunger 36. Unit fuel injector 10 also includes a metering chamber 40 formed near the lower end of central bore 14 for receiving a metered quantity of fuel for injection on a periodic basis. The metered fuel is received via a metering circuit (not shown) formed in the injector body, such as disclosed in U.S. Pat. Nos. 4,721,247 and 5,611,317, commonly assigned to the assignee of the present application and the entire contents of which are hereby incorporated by reference.

Unit fuel injector 10 also includes a scavenge circuit 42 for providing a drain passage for fuel to flow from central bore 14 while permitting any combustion gas leaking into the injector through injection orifices 24 to be removed thereby providing both a cooling function and a scavenging function to permit more effective metering of fuel during the next cycle. Scavenge circuit 42 includes a first passage 44 formed in nozzle housing 30 and a second passage 46 formed in spring housing 28 for connecting first passage 44 to a low pressure drain. As discussed hereinbelow, scavenge circuit 42 is designed to deliver fuel and combustion gas directly to the low pressure drain thereby permitting greater control over the timing of injection.

Fluid timing arrangement 20 is provided to vary the timing of each periodic injection of metered fuel dependent upon the pressure of a timing fluid supplied to the injector body. Timing fluid arrangement 20 includes upper plunger 34, intermediate plunger 38 and a variable volume timing chamber formed in the central bore between intermediate plunger 38 and upper plunger 34. Timing chamber 48 receives timing fluid, i.e. fuel, via inlet ports or orifices 50 formed in outer barrel 26. In FIG. 1, timing chamber 48 is shown in the collapsed state at the beginning of the timing and metering phase of injector operation during which a precisely metered quantity of timing fluid will be delivered to timing chamber 48 in accordance with the known "pressure/time" principle whereby the amount of timing fluid actually metered is primarily a function of the supply pressure and, secondarily, a function of the total time that timing fluid flows through inlet ports 50. As a result, the amount of timing fluid entering timing chamber 48 can be effectively controlled and varied by controlling the timing fluid supply pressure. A precisely metered quantity of timing fluid enters timing chamber 48 to form a fluid link having a variable effective length. For any given set of conditions, a fluid link has a predetermined effective length corresponding to the desired injection timing. At the end of the injection event, the upper edge of timing plunger 38 uncovers outlet ports 52 allowing timing fluid to spill through ports 52 to a low pressure drain via a spill regulator valve 54. Spill regulator valve 54 may be the type of valve disclosed in U.S. Pat. No. 5,275,337 issued to Kolarik et al., and commonly assigned to the assignee of the present application, which is hereby incorporated by reference.

Figure 2:
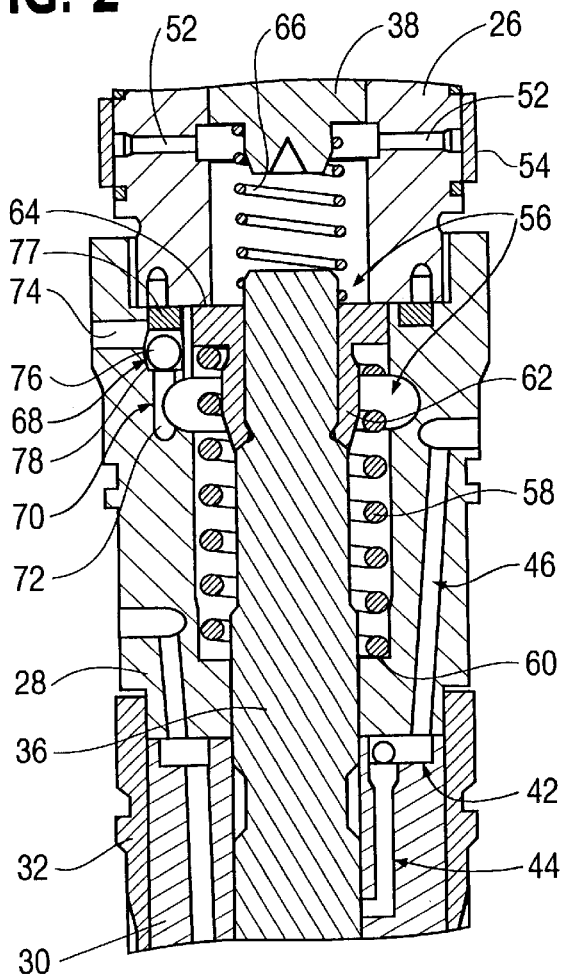
FIG. 2 is an enlarged cross sectional view of a portion of the unit fuel injector of FIG. 1 showing the spring chamber drain valve of the present invention.

Unit fuel injector 10 also includes an intermediate or spring chamber 56 positioned axially between timing plunger 38 and metering chamber 40 as best shown in FIG. 1. Referring to FIG. 2, in the preferred embodiment, spring chamber 56 is formed in both spring housing 28 and outer barrel 26. Spring chamber 56 is designed to receive a return spring 58 seated at one end against a lower seating surface 60 formed on barrel 26, and at an opposite end against an upper spring keeper 62 having a stepped washer-like construction. A stop surface 64 is provided on outer barrel 26 for abutment by spring keeper 62 thereby limiting the upward movement of spring keeper 62 and lower plunger 36. By limiting the retraction stroke of lower plunger 36, this stopping arrangement minimizes any negative pressure effect produced in metering chamber 40 thereby limiting the tendency of gas to be drawn into the metering chamber and thus increasing the predictability of injection fuel metering while preventing detonation of the fuel metered into the chamber 40. The structure and function of a similar stopping arrangement is discussed in detail in U.S. Pat. No. 5,299,738 to Genter et al., commonly assigned to the assignee of the present application, and the contents of which is hereby incorporated by reference.

Spring chamber 56 also preferably includes a second spring 66 positioned with one end in abutment against spring keeper 62 and an opposite end engaging timing plunger 38. Second spring 66 functions to provide a controlled bias pressure against timing plunger 38 for maintaining a controlled low pressure in timing chamber 48 to enhance the metering of the timing fluid into the timing chamber 48. Second spring 66 ensures that a near ambient pressure exists in timing chamber 48 which applicant has shown to enhance metering by allowing the inlet ports or orifices 50 to be calibrated and designed to achieve the required range of injection timing.

Importantly, unit fuel injector 10 of the present invention includes a spring chamber drain valve device 68 for directing leakage fuel and leakage timing fluid from spring chamber 56 to a low pressure drain while preventing flow from the low pressure drain into spring chamber 56. Spring chamber drain valve device 68 includes a drain circuit 70 formed in spring housing 28 for permitting fluidic communication between spring chamber 56 and the low pressure drain. Drain circuit 70 includes an axial passage 72 and a radial passage 74. Spring chamber drain valve device 68 also includes a ball check valve 76 mounted in axial passage 72 and a valve seat 78 formed on spring housing 28 surrounding axial passage 72 for sealing engagement by ball check valve 76. A washer 77 is positioned in a groove formed in the inner top surface of spring housing 28 for properly positioning, and protecting, ball check valve 76. Thus, ball check valve 76 moves between an open position permitting flow of leakage fuel and timing fluid from spring chamber 56 to the low pressure drain and a closed position blocking any back flow of fuel from the low pressure drain into spring chamber 56. As a result, spring chamber 56 is isolated from the drain system resulting in the advantages discussed hereinbelow.

During operation, high pressure injection fuel may leak through the clearance between lower plunger 36 and the opposing wall of nozzle housing 30 and spring housing 28 forming central bore 14, into spring chamber 56. In addition, timing fluid, i.e. fuel, may leak through the clearance between timing plunger 38 and the opposing wall of outer barrel 26 forming central bore 14, into spring chamber 56. Importantly, drain circuit 70 permits the pressurized leakage fuel and leakage timing fluid to be removed from spring chamber 56 by directing the leakage fuel and timing fluid to the low pressure drain. The draining of leakage fuel and timing fluid from spring chamber 56 is intended to prevent a buildup of pressure in spring chamber 56 thereby preventing any buildup pressure from interfering with the metering of timing fluid into timing chamber 48 by avoiding undesirable pressure forces on timing plunger 38 caused by the leakage pressure in spring chamber 56. Importantly, applicants have recognized that pressure variations in the low pressure drain system may cause back pressure variations in spring chamber 56 thereby interfering with the precision metering of timing fluid into timing chamber 48 by causing undesirable pressure forces to act on timing plunger 38. In the conventional injector without spring chamber drain valve device 68, the pressure variations in spring chamber 56 unpredictably vary the required timing fuel pressure necessary to achieve the quantity of timing fluid metering into timing chamber 48 thereby causing undesirable and unpredictable variations in the length of the fluid link in timing chamber 48 and thus uncontrollable variations in the start of injection. Spring chamber drain valve device 68 effectively isolates the spring chamber 56 from the drain line back pressure thereby minimizing undesired injection timing variation. Thus the ball check valve 76 prevents high pressure spikes from the low pressure drain line from entering the spring chamber 56 and adversely affecting the timing fluid metering process.

Importantly, unit injector 10 of the present invention also avoids outside influences on timing fluid metering by directing the scavenge flow through scavenge circuit 42 directly to the low pressure drain without fluidically communicating with spring chamber 56. As a result, no scavenge flow is delivered to spring chamber 56. Conventional open nozzle injectors, including a scavenge flow system, direct the scavenge flow of fuel and combustion gas into the spring chamber for delivery to the low pressure drain via the drain circuit. However, the scavenge flow results in pressure variations in spring chamber 56 and thus variable pressure forces on timing plunger 38 thereby causing deviations in the amount of timing fluid metered into timing chamber 48 and unpredictable variations in the start of injection. Obviously, these variations cannot be controlled in any predictable manner to permit the pressure of the timing fluid to be altered to compensate effectively. The fuel injector 10 of the present invention avoids outside influences, such as the drain line back pressure and the scavenge flow pressure in spring chamber 56, while incorporating second spring 66 to provide a relatively low controlled biasing force against timing plunger 38 and thus a controlled pressure in timing chamber 48, resulting in controllable timing fluid metering and optimal control of the timing of injection with minimal undesired start of injection variations. In addition, limiting the amount of fuel in spring chamber 56 reduces the amount of fuel to be displaced during maximum timing advance conditions thereby also reducing start of injection variation. Also, in the conventional injector, the scavenge flow introduced into spring chamber 56 also required unnecessarily large drain passages from spring chamber 56 to accommodate the drain flow thereby increasing the exposure of the spring chamber 56 to drain back pressure. Other injector designs use a stop surface to limit the retraction of the timing plunger. However, limiting timing plunger movement disadvantageously limits the injection timing range due to the vacuum created in the timing chamber as the upper plunger continues upward movement. The vacuum functions to assist the metering flow of timing fluid which prevents achieving maximum retardation of timing. Although the size of inlet ports 52 can be reduced to achieve maximum timing retardation, maximum timing advancement cannot then be obtained.

Thus, it can be seen that during operation, spill chamber drain valve device 68 allows fuel in spring chamber 56 to be vented to drain as the injector is stroked. Ball check valve 76 is moved between open and closed positions by differential fluid pressure across the valve. As upper plunger 34 and timing plunger 38 begin the retraction stroke, a vacuum is created in spring chamber 56 which tends to pull the ball check valve 76 into engagement against valve seat 78 thereby isolating chamber 56 from any drain line spikes or fluctuations. Although a vacuum is created in spring chamber 56, the timing feed port size is not appreciably adversely affected since the timing fluid pressure in timing chamber 48 is acting against the bias spring load of second spring 66. As a result, the inlet ports or orifices 56 can be calibrated/designed to achieve the required timing range. In other words, the bottom of timing plunger 38 is isolated from drain line fluctuations and scavenge flow while the timing feed port diameter can be designed large enough to achieve the desired timing range for injection.

Industrial Applicability

The unit fuel injector of the present invention can be used on any combustion engine of any vehicle or industrial equipment in which accurate control and variation of the timing of injection of fuel is essential.

We claim:

1. A unit fuel injector for injecting fuel into a combustion chamber of an internal combustion engine, comprising:

an injector body containing a central bore and an injection orifice formed in one end to discharge fuel into the combustion chamber;

a lower plunger positioned for reciprocal movement in said central bore;

a metering chamber positioned between said lower plunger and said injection orifice for receiving a metered quantity of fuel for injection on a periodic basis;

fluid timing means for varying the timing of each periodic injection of metered fuel dependent upon the pressure of a timing fluid supplied to said injector body, said fluid timing means including an upper plunger mounted for reciprocal movement within said central bore, an intermediate plunger mounted for reciprocal movement within said central bore between said upper and said lower plungers and a variable volume timing chamber formed in said central bore between said intermediate plunger and said upper plunger for receiving timing fluid to form a fluid link having a variable effective length;

a spring chamber formed axially between said intermediate plunger and said metering chamber;

a spring means positioned in said spring chamber for biasing at least one of said intermediate plunger and said lower plunger toward said upper plunger; and a spring chamber drain valve means for directing fuel and timing fluid from said spring chamber to a low pressure drain and for preventing flow from said low pressure drain into said spring chamber.

2. The unit fuel injector of claim 1, wherein said spring chamber drain valve means includes a ball check valve.

3. The unit fuel injector of claim 2, wherein said injector body includes a spring housing, said spring chamber drain valve means further including a drain passage formed in said spring housing and a valve seat formed on said spring housing for engagement by said ball check valve.

4. The unit fuel injector of claim 3, wherein said ball check valve moves axially along a longitudinal axis of the injector body between an open position and a closed position.

5. The unit fuel injector of claim 2, wherein said ball check valve is moved between an open position and a closed position solely by differential fluid pressure across said ball check valve.

6. The unit fuel injector of claim 1, wherein the unit fuel injector is an open nozzle injector and said spring means includes a first coil spring biasing said lower plunger toward said upper plunger and a second coil spring biasing said intermediate plunger toward said upper plunger.

7. The unit fuel injector of claim 1, further including a scavenge flow circuit formed in said injector body for directing a scavenge flow of fuel through the injector body to remove combustion gas from said central bore, said scavenge flow circuit being fluidically separate from said spring chamber for bypassing fuel and gas around said spring chamber for delivery directly to said low pressure drain.

8. The unit fuel injector of claim 1, wherein said intermediate plunger is mounted for unrestricted movement toward said upper plunger.

9. A unit fuel injector for injecting fuel into a combustion chamber of an internal combustion engine, comprising:

an injector body containing a central bore and an injection orifice formed in one end to discharge fuel into the combustion chamber;

a plunger assembly positioned for reciprocal movement in said central bore and including a lower plunger, an upper plunger and an intermediate plunger mounted between said upper and said lower plungers;

a timing chamber formed in said central bore between said intermediate plunger and said upper plunger for receiving timing fluid to form a fluid link having a variable effective length, said variable effective length dependent on the pressure of the timing fluid delivered to said timing chamber;

an intermediate chamber formed axially between said intermediate plunger and said lower plunger; and an intermediate chamber drain valve means for directing fuel and timing fluid from said intermediate chamber to a low pressure drain and for preventing flow from said low pressure drain into said intermediate chamber to isolate said intermediate chamber from drain pressure.

10. The unit fuel injector of claim 9, wherein said intermediate chamber drain valve means includes a ball check valve.

11. The unit fuel injector of claim 10, wherein said injector body includes an intermediate housing, said intermediate chamber drain valve means further including a drain passage formed in said intermediate housing and a valve seat formed on said intermediate housing for engagement by said ball check valve.

12. The unit fuel injector of claim 11, wherein said ball check valve moves axially along a longitudinal axis of the injector body between an open position and a closed position.

13. The unit fuel injector of claim 10, wherein said ball check valve is moved between an open position and a closed position solely by differential fluid pressure across said ball check valve.

14. The unit fuel injector of claim 9, wherein the unit fuel injector is an open nozzle injector, further including a spring means positioned in said intermediate chamber for biasing at least one of said intermediate plunger and said lower plunger toward said upper plunger.

15. The unit fuel injector of claim 14, wherein said spring means includes a first coil spring biasing said lower plunger toward said upper plunger and a second coil spring biasing said intermediate plunger toward said upper plunger.

16. The unit fuel injector of claim 9, further including a scavenge flow circuit formed in said injector body for directing a scavenge flow of fuel through the injector body to remove combustion gas from said central bore, said scavenge flow circuit being fluidically separate from said intermediate chamber for bypassing fuel and gas around said intermediate chamber for delivery directly to said low pressure drain.

17. The unit fuel injector of claim 9, wherein said intermediate plunger is mounted for unrestricted movement toward said upper plunger.

* * * * *